US006522084B1

(12) United States Patent
Miyazaki et al.

(10) Patent No.: US 6,522,084 B1
(45) Date of Patent: Feb. 18, 2003

(54) ELECTRODELESS DISCHARGE LAMP OPERATING APPARATUS

(75) Inventors: Koji Miyazaki, Osaka (JP); Toshiaki Kurachi, Osaka (JP); Mamoru Takeda, Kyoto (JP); Katsushi Seki, Shiga (JP); Young-Jae Cho, Seoul (KR)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 09/868,369

(22) PCT Filed: Oct. 12, 2000

(86) PCT No.: PCT/JP00/07098

§ 371 (c)(1),
(2), (4) Date: Jun. 15, 2001

(87) PCT Pub. No.: WO01/29877

PCT Pub. Date: Apr. 26, 2001

(30) Foreign Application Priority Data

Oct. 18, 1999 (JP) ..... 11-295042

(51) Int. Cl.[7] ..... H05B 41/16

(52) U.S. Cl. ..... 315/248; 315/56; 313/638; 313/634; 313/643

(58) Field of Search ..... 315/248, 56, 57, 315/58, 246, 283; 359/154, 155, 157, 159, 163, 171; 313/634, 637, 638, 643, 641

(56) References Cited

U.S. PATENT DOCUMENTS

| | | | | |
|---|---|---|---|---|
| 4,119,889 A | * | 10/1978 | Hollister | 313/116 |
| 4,636,692 A | * | 1/1987 | Lapatovich et al. | 313/25 |
| 5,650,695 A | * | 7/1997 | Daniels et al. | 315/248 |
| 5,751,110 A | | 5/1998 | Spaapen et al. | 313/550 |
| 5,798,618 A | * | 8/1998 | van Os et al. | 313/490 |
| 6,157,133 A | * | 12/2000 | Shamamian et al. | 313/607 |

FOREIGN PATENT DOCUMENTS

| | | |
|---|---|---|
| JP | 05225960 | 9/1993 |
| JP | 06013049 | 1/1994 |
| JP | 8-2122980 | 8/1996 |

* cited by examiner

*Primary Examiner*—Don Wong
*Assistant Examiner*—Tuyet T. Vo
(74) *Attorney, Agent, or Firm*—Harness, Dickey & Pierce, PLC

(57) ABSTRACT

An electrodeless discharge lamp operating apparatus includes a transparent discharge vessel (1) in which a luminescent substance is enclosed; a coil (3) for generating an alternating electromagnetic field that discharges the luminescent substance; a power source (4) for supplying alternating current to the coil (3). The coil (3) comprises at least a magnetic material, and is disposed on an inner side than the outer side wall of the discharge vessel (1), and the luminescent substance comprises at least a rare gas, and does not comprise mercury.

6 Claims, 2 Drawing Sheets

ELECTRODELESS DISCHARGE LAMP OPERATING APPARATUS

TECHNICAL FIELD

The present invention relates to electrodeless discharge lamp operating apparatuses.

BACKGROUND ART

Electrodelss discharge lamps (or electrodeless low-pressure discharge lamps) have excellent characteristics including a resource saving effect of long life and an energy saving effect of high efficiency, so that electrodeless discharge lamps have been widely noted in the illumination field in recent years. Hereinafter, a conventional electrodeless low-pressure discharge lamp operating apparatus will be described with reference to FIG. 2.

FIG. 2 shows the structure of a conventional electrodeless low-pressure discharge lamp operating apparatus, and an electrodeless low-pressure discharge lamp operating apparatus having such a structure is disclosed in, for example Japanese Laid-Open Patent Publication No. 58-57254.

The electrodeless low-pressure discharge lamp operating apparatus shown in FIG. 2 includes a discharge vessel 21 enclosing a luminescent metal and rare gas therein, a phosphor 22 applied onto an inner face of the discharge vessel 21, and a coil 23 inserted in a recessed portion 21*a* of the discharge vessel 21. The phosphor 22 is used to convert ultraviolet rays occurring in the discharge vessel 21 to visible light. The coil 23 is constituted by a rod-shaped core 23*a* made of a magnetic material such as ferrite and a winding 23*b*. The rod-shaped core 23*a* of the coil 23 has a rod-shaped member 26 made of a thermal conductive material in its central axis (a hatched portion in FIG. 2). The rod-shaped member 26 serves to dissipate and suppress the heat of the coil 23 that is generated during lamp operation.

The discharge vessel 21 is supported by a metal case 25, and the rod-shaped member 26 provided inside the recessed portion 21*a* of the discharge vessel 21 and the metal case 25 are coupled to each other. In such a structure, it is intended to minimize the heat generation of the coil by dissipating the heat generated in the coil 23 from the metal case 25 through the rod-shaped member 26. A power source 24 for supplying high frequency alternating current to the winding 23*b* is provided in the metal case 25. In other words, the lamp is configured so that an alternating magnetic field occurs from the coil 23 by the high frequency alternating current from the power source 24. A lamp base 27 is attached to a part (a lower part) of the metal case 25.

Next, the operation of the electrodeless low-pressure discharge lamp operating apparatus shown in FIG. 2 will be described.

First, an alternating magnetic field is generated in the discharge vessel 21 from the coil 23 with the high frequency alternating current supplied from the power source 24 to the winding 23*b*. Then, an alternating electric field occurs in the discharge vessel 21 to cancel this alternating magnetic field. The luminescent metal and rare gas in the discharge vessel 21 collide with each other repeatedly so as to be excited by this alternating electric field so that a plasma is formed in the discharge vessel 21. Ultraviolet rays are radiated from the plasma and the ultraviolet rays are converted to visible light with the phosphor 22. Thus, the visible light is emitted outwardly from the discharge vessel 21. In this manner, the electrodeless low-pressure discharge lamp operating apparatus shown in FIG. 2 emits light.

In the above-described operation, the coil 23 is forced to operate at a quite high temperature caused by the heat generated by a loss due to the alternating current supplied to the winding 23*b* and the heat generated by heat conduction from the plasma. Furthermore, the recessed portion 21*a* in the discharge vessel 21 where the coil 23 is provided is constituted by a closed space, so that heat is unlikely to be dissipated, and therefore it is necessary to take some measure to dissipate the heat for the electrodeless low-pressure discharge lamp operating apparatus. Japanese Laid-Open Patent Publication No. 58-57254 describes as a measure for dissipation that the rod-shaped member 26 made of a thermal conductive material is inserted in the central axis of the rod-shaped core 23*a,* and the heat generated in the coil 23 is dissipated from the metal case 25 through the rod-shaped member 26 by coupling the rod-shaped member 26 and the metal case 25.

In the conventional structure as above, it is necessary to use a material having good thermal conductivity for the rod-shaped member 26, and it is generally assumed that a metal can be used. In the case of the rod-shaped member 26 made of a metal, an eddy current is generated in the rod-shaped member 26 by a magnetic field occurring in the coil 23, and thus a loss occur. Similarly, a loss due to the eddy current also occurs in the metal case 25. Therefore, in the above conventional structure, the generated eddy current reduces the lamp efficiency, and sufficient heat dissipation effects cannot be obtained. Furthermore, since this structure is very complicated where the rod-shaped member 26 of the central axis of the rod-shaped core 23*a* is inserted, and the rod-shaped member 26 and the metal case 25 are coupled, disadvantageously resulting in a large apparatus.

Furthermore, since a metal and rare gas are enclosed as the luminescent substance, the luminous flux is low during a period from turning on the power to evaporation of the metal, and the start of lighting takes time. In addition, the metal vapor pressure is significantly varied by the variation of the ambient temperature, so that the variation of the luminous flux disadvantageously is large. The variation of the metal vapor pressure leads to the variation of the electrical characteristics of the plasma, and therefore the power source 24 that can cope with a wide range of load variations can be of a complicated structure, disadvantageously resulting in a large apparatus. Moreover, mercury generally is used as the luminous metal to radiate ultraviolet rays. However, there is a great demand for reducing the amount of mercury used in view of environmental protection.

The present invention is carried out in view of the above problems, and it is a main object of the present invention to provide an electrodeless low-pressure discharge lamp operating apparatus that can suppress an increase of the temperature of the coil.

DISCLOSURE OF INVENTION

An electrodeless discharge lamp operating apparatus of the present invention includes a transparent discharge vessel in which a luminescent substance is enclosed; a coil for generating an alternating electromagnetic field that discharges the luminescent substance; a power source for supplying alternating current to the coil, wherein the coil comprises at least a magnetic material, and is disposed on an inner side than the outer side wall of the discharge vessel, and the luminescent substance comprises at least a rare gas, and does not comprise mercury.

In one embodiment, the coil is inserted in a recessed portion provided in the discharge vessel.

In one embodiment, a frequency of the alternating current supplied by the power source is in a range from 40 kHz or more and 500 kHz or less.

In one embodiment, the electrodeless discharge lamp operating apparatus further includes a phosphor applied onto an inner face of the discharge vessel, and ultraviolet rays occurring in the discharge vessel are converted to visible light with the phosphor.

In one embodiment, the luminescent substance is a rare gas, and the rare gas is at least one selected from the group consisting of xenon, argon, krypton, neon, and helium and a mixture of these rare gas.

It is preferable that the rare gas comprises at least xenon.

In one embodiment, a pressure in the discharge vessel before discharge start is in a range from 0.1 torr or more and 3.0 torr or less.

BEST MODE FOR CARRYING OUT THE INVENTION

The inventors of the present invention found that surprisingly, an increase of the temperature of a coil is suppressed in an electrodeless discharge lamp operating apparatus (electrodeless low-pressure discharge lamp operating apparatus) where a coil is disposed on an inner side than the outer side wall of a discharge vessel, and rare gas (e.g., xenon) is enclosed in the discharge vessel without using mercury as a luminescent substance. Thus, this discovery leads to the present invention. Hereinafter, embodiments of the present invention will be described with reference to the accompanying drawings. However, the present invention is not limited by the following embodiments.

Figure 1:
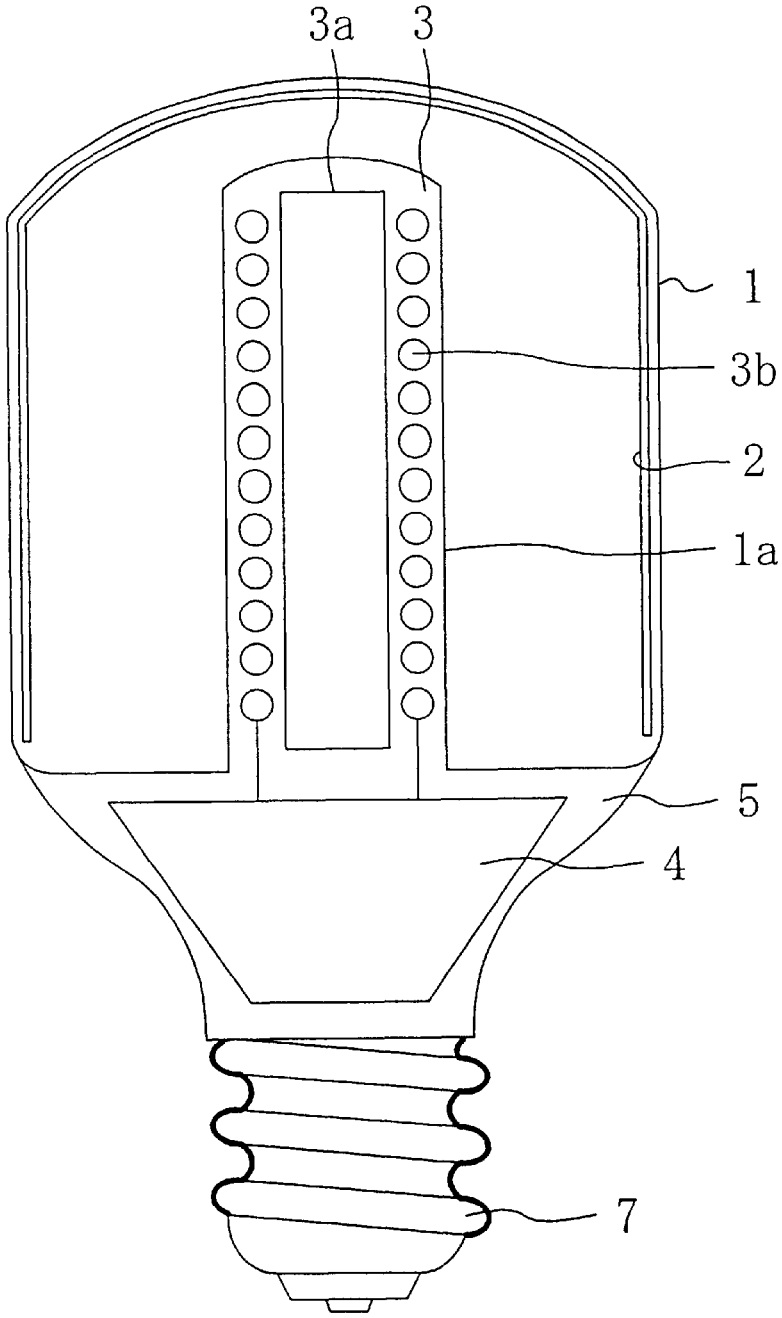
FIG. 1 is a configuration diagram of an electrodeless discharge lamp operating apparatus according to an embodiment of the present invention.
Figure 2:
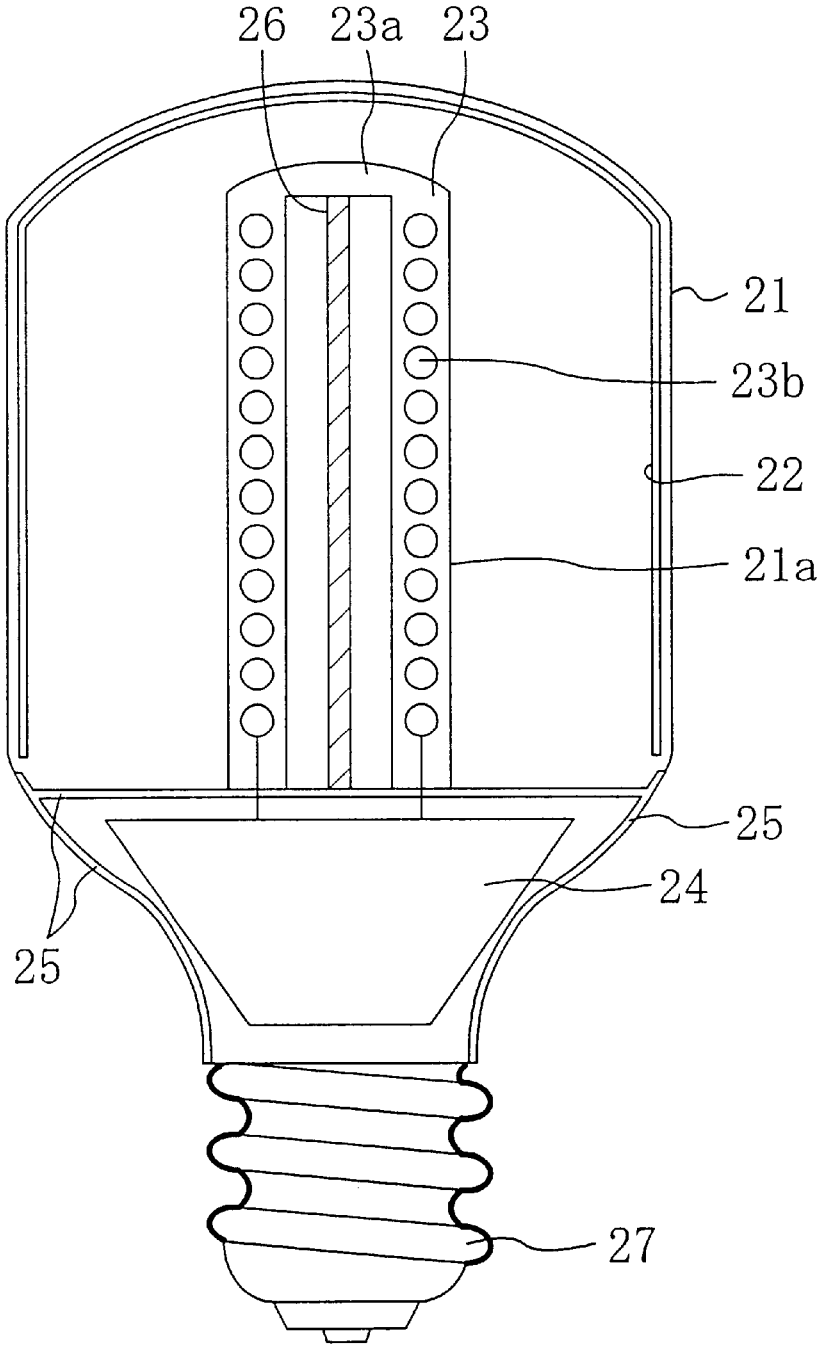
FIG. 2 PRIOR ART
FIG. 2 is a configuration diagram of a conventional electrodeless discharge lamp operating apparatus.

FIG. 1 schematically shows the structure of an electrodeless low-pressure discharge lamp operating apparatus according to an embodiment of the present invention.

The electrodeless low-pressure discharge lamp operating apparatus of this embodiment includes a transparent discharge vessel 1 enclosing a luminescent substance, a coil 3 generating an alternating electromagnetic field that discharges the luminescent substance in the discharge vessel 1, and a power source 4 for supplying alternating current to the coil 3. The coil 3 contains at least a magnetic material, and is disposed on an inner side than the outer side wall of the discharge vessel 1. The luminescent substance in the discharge vessel 1 contains at least rare gas but does not contain mercury.

The luminescent substance is a gas composed of, for example, rare gas alone, and as the rare gas, xenon, argon, krypton, neon, or helium can be used. Furthermore, a mixed gas of these gases can be used as well. In view of the luminous efficiency, it is preferable to use at least xenon. In this embodiment, the pressure in the discharge vessel 1 before the start of discharge is 0.1 torr or more and 3.0 torr or less (13.33 Pa or more and 400 Pa or less), for example.

A phosphor 2 is applied onto an inner face of the discharge vessel 1, and ultraviolet rays occurring in the discharge vessel 1 are converted to visible light with the phosphor 2. The thickness of the phosphor (a phosphor layer) 2 is about 50 $\mu$m, for example. The thickness of the discharge vessel 1 in this embodiment is about 0.8 mm. The discharge vessel 1 is made of, for example, soda-lime glass, and the height of the discharge vessel 1 is about 65 mm, and the volume of the discharge 1 is about 160 $cm^3$.

The coil 3 includes a core portion 3*a* having a substantially rod shape made of a magnetic material (e.g., ferrite) and a winding (e.g., copper wire) 3*b*. The coil 3 is inserted in a recessed portion 1*a* provided in the central portion of the discharge vessel 1, and the winding 3*b* of the coil 3 is electrically connected to the power source 4. In this specification, the outer side wall of the discharge vessel 1 refers to the wall on the side from which light is emitted. The recessed portion 1*a* is not positioned on the side from which light is emitted, and therefore the recessed portion 1*a* is not included in the outer side wall of the discharge vessel 1.

The power source 4 supplies alternating current in the range, for example, from 40 kHz or more and 500 kHz or less to the coil 3. The power source 4 in this embodiment includes a ballast. The power source 4 is disposed inside a cover 5, and the cover 5 is constituted with, for example, polybutylene terephthalale (PBT). The cover 5 supports the discharge vessel 1, and a lamp base 7 is provided on the side opposite to the side where the discharge vessel 1 is provided. The lamp base 7 is electrically connected to the power source 4. The electrodeless low-pressure discharge lamp operating apparatus of this embodiment has a structure in which the discharge vessel 1, the coil 3 and the power source 4 (and the lamp base 7) are integrated.

Next, the operation of the electrodeless low-pressure discharge lamp operating apparatus shown in FIG. 1 will be described below.

First, an alternating magnetic field is generated from the coil 3 by the alternating current supplied from the power source 4 to the winding 3b. The generated alternating magnetic field generates an electric field in the discharge vessel 1, and the luminescent substance in the discharge vessel 1 repeat accelerated collision and is excited by the electric field so that ultraviolet rays are generated. The generated ultraviolet rays are converted to visible light with the phosphor 2, and the visible light is emitted from the outer side wall of the discharge vessel 1. Thus, emission principle is basically the same as that of prior art, but the electrodeless low-pressure discharge lamp operating apparatus of this embodiment does not contain mercury as a luminescent substance.

Table 1 shows the experimental results of measuring the maximum temperature of the coil 3, and the current and the voltage at the winding 3*b* in the following cases: the case where mercury is enclosed (Comparative Example), the case where argon is enclosed; and the case where xenon is enclosed as a main luminescent substance enclosed in the discharge vessel 1 in the structure shown in FIG. 1. The experimental conditions were 100 kHz as the frequency supplied to the winding 3*b;* and about 30 W as the power supplied to the discharge vessel 1.

TABLE 1

| Luminescent substance | Maximum temperature of coil 3 (° C.) | Current flowing through winding 3b (A) | Voltage at winding 3b (V) |
|---|---|---|---|
| Mercury (Comparative Example) | 240 | 2.4 | 540 |
| Argon | 210 | 1.7 | 383 |
| Xenon | 200 | 1.2 | 270 |

In the case where mercury was enclosed as a luminescent substance (luminescent metal) as in Comparative Example, the maximum temperature of the coil 3 was 240° C., and the lamp turned off in a period as short as one hour after the start of lighting. It is believed that the reason why the lamp turned off is that the Curie point of the magnetic material 3*a* used was 240° C., so that the inductance is reduced and the magnetic field is not generated any more. On the other hand, in the case where a rare gas of xenon or argon is enclosed, the maximum temperature of the coil 3 is 30 to 40° C. lower, so that the lamp did not turn off.

In the case where mercury is enclosed (the structure of Comparative Example), it is necessary to reduce the temperature of the coil 3 by providing a dissipation member to prevent the lamp from turning off. However, the dissipation member is not required, in the case where only rare gas such as xenon or argon is enclosed (the structure of this embodiment), because the maximum temperature of the coil 3 is 30 to 40° C. lower than that of the structure of mercury enclosed. Even if a magnetic material having a low Curie point is used and it is necessary to further reduce the temperature of the coil 3, a dissipation member having a simple structure is sufficient for the structure of this embodiment where xenon or argon is enclosed.

It is believed that the difference in the temperature of the coil 3 between the case of mercury being enclosed and the case of mercury not enclosed is caused by the difference in the current flowing through the winding 3*b*. More specifically, the current flowing through the winding 3*b* is smaller in the case of xenon enclosed (1.2 A) or the case of argon enclosed (1.7 A) than in the case of mercury enclosed (2.4 A). Therefore, the heat generation due to copper loss in the winding 3*b* is lower in the case of xenon enclosed or the case of argon enclosed than in the case of mercury enclosed.

The factors causing the current flowing through the winding 3*b* to be lower in those cases are not clearly identified, but the inventors of the present invention inferred that this is caused by plasma impedance occurring in the discharge vessel 1. This inference will be described in detail. In the case where only rare gas is enclosed, the particle size of the enclosed substance is smaller than in the case where mercury and rare gas are enclosed. Therefore, the cross-section area of collision of the particles in the plasma is small. For this reason, the plasma impedance (plasma resistance) is reduced, and as a result, the plasma voltage is reduced. Here, when a plasma occurring in the discharge vessel 1 is regarded as a coil with one winding, for example, the structure shown in FIG. 1 can be regarded as having a transformer composed of a coil with one winding, and the coil 3 with N windings (a transformer having a ratio of the number of winding of 1: N). Therefore, when the plasma voltage in the discharge vessel 1 is reduced, the voltage occurring in the winding 3*b* is also reduced. When the voltage occurring in the winding 3*b* is reduced, the current flowing through the winding 3*b* is reduced. As a result, the coil loss (copper loss:$I^2R$ is suppressed so that the temperature of the coil 3 is reduced.

In the case where a rare gas is enclosed, the voltage occurring in the winding 3*b* can be reduced, and therefore the voltage generated from the power source 4 can be suppressed to low levels. Therefore, the power source 4 and the coil 3 can be insulated easily, so that the power source 4 and the coil 3 can be made small. In particular, in the case where the discharge vessel 1, the coil 3 and the power source 4 are integrated as in this embodiment, the effect of compactness is large.

Furthermore, in the structure where mercury is enclosed, the mercury vapor pressure becomes larger as the temperature of the discharge vessel 1 increases during a period from the early stage of lamp lighting to rated lighting. Therefore, the lamp of this structure has the nature that the luminous flux increases gradually. In addition, the plasma impedance is also varied, and thus the current flowing through the winding 3*b* and the voltage occurring in the winding 3*b* are significantly varied. Furthermore, the lamp of this structure has the nature that the luminous flux, the voltage and the current at the winding 3*b* are varied by the variation of the ambient temperature. On the other hand, in the structure where only rare gas is enclosed, the variation in the pressure in the discharge lamp can be significantly small. Therefore, the luminous flux increases swiftly, and a constant luminous flux can be obtained regardless of the ambient temperature. Furthermore, the variation of the voltage and the current at the winding 3*b* can be small. As a result, the design of the power source 4 can be easy and the structure of the power source 4 can be simple.

There is an outer winding type of the electrodeless low-pressure discharge lamp operating apparatus where the coil 3 is wound on the outer side of the discharge vessel 1. In the case of the outer winding type, the coil 3 is in contact with air, so that an increase of the coil temperature is not a very large problem. On the other hand, in the structure of this embodiment, the coil 3 is provided in a closed space (recessed portion 1*a*), so that it is significantly advantageous to suppress the temperature increase with a simple structure.

In this embodiment, the frequency of the alternating current supplied from the power source 4 to the winding 3*b* is in the range from 40 kHz to 500 kHz. This range is advantageous for reducing the copper loss in the winding 3*b* to reduce the temperature of the coil 3. In other words, frequencies of not less than 40 kHz prevent the current flowing through the winding 3*b* from being too large, and frequencies of not more than 500 kHz allow the surface resistance of the winding 3*b* from being large. In other words, the range from 40 kHz to 500 kHz effectively prevents the copper loss from being too large to prevent the temperature of the coil 3 from increasing.

Furthermore, the pressure in the discharge vessel 1 is preferably 0.1 torr to 3.0 torr (13.33 Pa to 400 Pa). In a region of 0.1 torr to 3.0 torr, discharge can start at a voltage occurring in the winding 3*b* of 1 kV or less. In other words, at a pressure of at less than 0.1 torr or more than 3.0 torr, a voltage of several kV or more is required at the winding 3*b* to start discharge, and components having a high withstand voltage are required to be used for the power source 4 and the coil 3. When the voltage to start discharge is as low as 1 kV or less, small general purpose electronic components can be used so that a even more compact apparatus can be achieved.

Furthermore, the electrodeless low-pressure discharge lamp operating apparatus of this embodiment does not require mercury as a luminescent substance at all, and the luminescent substance is composed of only harmless rare gas. Therefore, this is an ideal discharge lamp operating apparatus also in view of environmental protection. In this embodiment, the discharge vessel 1, the coil 3 and the power source 4 are integrated. However, the present invention is not limited thereto, and even if these components are discrete, the temperature of the coil 3 can be reduced as well, so that the voltage occurring in the coil 3 can be reduced. Furthermore, the luminescent substance is not limited to argon or xenon, but other rare gas such as krypton, neon, and helium or a mixture of rare gas can be used.

Industrial Applicability

According to the present invention, mercury is not enclosed in the discharge vessel as a luminescent substance, and at least rare gas is enclosed, so that an electrodeless discharge lamp operating apparatus in which the temperature increase of the coil can suppress can be provided. The electrodeless low-pressure discharge lamp operating apparatus of the present invention can be free from a member for dissipating heat. In addition, in the case where rare gas is used as a luminescent substance, plasma load variations can be small. Therefore, the power source structure can be simplified, and a compact lamp operating apparatus can be achieved. Furthermore, a constant luminous flux can be obtained regardless of the ambient temperature of the lamp operating apparatus, and lighting starts swiftly. In addition, it is possible to constitute it with only harmless luminous substance, so that this is preferable in view of environmental protection. Such an electrodeless low-pressure discharge lamp operating apparatus preferably can be used for a compact self-ballasted fluorescent lamp or other similar applications.

What is claimed is:

1. An electrodeless discharge lamp operating apparatus comprising:

a translucent discharge vessel in which a luminescent substance is enclosed;

a coil for generating an alternating electromagnetic field that discharges the luminescent substance;

a power source for supplying alternating current to the coil, wherein the coil comprises at least a magnetic material, and is disposed on an inner side than the outer side wall of the discharge vessel, a frequency of the alternating current supplied by the power source is in a range from 40 kHz or more and 500 kHz or less, and the luminescent substance comprises at least a rare gas, and does not comprise mercury.

2. The electrodeless discharge lamp operating apparatus of claim 1, wherein the coil is inserted in a recessed portion provided in the discharge vessel.

3. The electrodeless discharge lamp operating apparatus of claim 1, further comprising a phosphor applied onto an inner face of the discharge vessel, and ultraviolet rays occurring in the discharge vessel are converted to visible light with the phosphor.

4. The electrodeless discharge lamp operating apparatus of claim 1, wherein the luminescent substance is a rare gas, and the rare gas is at least one selected from the group consisting of xenon, argon, krypton, neon, and helium and a mixture of these rare gas.

5. The electrodeless discharge lamp operating apparatus of claim 4, wherein the rare gas comprises at least xenon.

6. The electrodeless discharge lamp operating apparatus of any one of claims 1 to 5, wherein a pressure in the discharge vessel before discharge start is in a range from 0.1 torr or more and 3.0 torr or less.

* * * * *

UNITED STATES PATENT AND TRADEMARK OFFICE

CERTIFICATE OF CORRECTION

PATENT NO. : 6,522,084 B1
DATED : February 18, 2003
INVENTOR(S) : Koji Miyazaki et al.

It is certified that error appears in the above-identified patent and that said Letters Patent is hereby corrected as shown below:

Title Page,
Item [73], Assignee, "Kadoma" should be -- Osaka --.
Item [56], References Cited, U.S. PATENT DOCUMENTS, insert:

| | | | |
|---|---|---|---|
| -- 2,030,957 | 2/1936 | Bethenod, et al. | 176/122 |
| 4,005,330 | 1/1977 | Glascock, Jr., et al. | 315/57 |
| 4,187,445 | 2/1980 | Houston | 315/54 |
| 5,635,802 | 6/1997 | Gielen | 315/248 --. |

FOREIGN PATENT DOCUMENTS, insert -- GB 1334911 10/1973 --.

Signed and Sealed this

Sixth Day of January, 2004

JAMES E. ROGAN
*Director of the United States Patent and Trademark Office*